US006305547B1

(12) United States Patent
Curran

(10) Patent No.: US 6,305,547 B1
(45) Date of Patent: Oct. 23, 2001

(54) LUNCH BOX OR SIMILAR CARRIER INCORPORATING AN AUDIO RECORDING/ TRANSMITTING SYSTEM

(76) Inventor: Karen M. Curran, 151 John D. St., LaVergne, TN (US) 37086

( * ) Notice: Subject to any disclaimer, the term of this patent is extended or adjusted under 35 U.S.C. 154(b) by 0 days.

(21) Appl. No.: 09/532,525

(22) Filed: Mar. 21, 2000

Related U.S. Application Data

(63) Continuation-in-part of application No. 09/216,755, filed on Dec. 18, 1998, which is a continuation of application No. 08/792,286, filed on Jan. 31, 1997, now abandoned.

(51) Int. Cl.[7] ..... A45C 11/20

(52) U.S. Cl. ..... 206/542; 206/541; 206/459.1

(58) Field of Search ..... 206/372, 373, 206/459.1, 541, 542, 543, 544, 545, 546, 547, 548, 549

(56) References Cited

U.S. PATENT DOCUMENTS

| | | | | |
|---|---|---|---|---|
| D. 237,134 | | 10/1975 | Westmoreland . | |
| 3,777,418 | | 12/1973 | Copper . | |
| 4,050,493 | | 9/1977 | Cho . | |
| 4,279,342 | | 7/1981 | Van Pelt . | |
| 4,571,740 | | 2/1986 | Kirby et al. . | |
| 4,654,728 | * | 3/1987 | Lunsford | 360/74.1 |
| 4,817,191 | | 3/1989 | Adams . | |
| 4,939,912 | | 7/1990 | Leonovich, Jr. . | |
| 4,971,320 | | 11/1990 | Nesbit et al. . | |
| 5,063,698 | | 11/1991 | Johnson et al. . | |
| 5,074,417 | | 12/1991 | Kenny . | |
| 5,235,822 | | 8/1993 | Leonovich, Jr. . | |
| 5,241,427 | * | 8/1993 | Lin | 360/1 |
| 5,276,472 | | 1/1994 | Bell et al. . | |
| 5,279,514 | | 1/1994 | Lacombe et al. . | |
| 5,351,818 | | 10/1994 | Daneshuar . | |
| 5,387,108 | * | 2/1995 | Crowell | 434/319 |
| 5,404,343 | | 4/1995 | Boggio . | |
| 5,447,041 | | 9/1995 | Piechota . | |
| 5,459,702 | | 10/1995 | Greenspan . | |
| 5,473,729 | | 12/1995 | Bryant et al. . | |
| 5,499,465 | | 3/1996 | Manico . | |
| 5,500,636 | * | 3/1996 | Mitchell | 340/328 |
| 5,651,049 | | 7/1997 | Easterling et al. . | |
| 5,752,335 | | 5/1998 | Shimogori et al. . | |
| 5,810,168 | | 9/1998 | Eggering . | |
| 5,864,288 | | 1/1999 | Hogan . | |
| 5,903,869 | | 5/1999 | Jacobson et al. . | |
| 5,905,429 | | 5/1999 | Hornstein et al. . | |

* cited by examiner

*Primary Examiner*—David T. Fidei
(74) *Attorney, Agent, or Firm*—Waddey & Patterson; Richard S. Myers, Jr.

(57) ABSTRACT

A carrier or container for transporting food or beverages having a built-in audio system. The exterior of the carrier includes indicia which, in the preferred embodiment, is associated with a well-known theme, character or personality. The audio system includes a recording device and transmitting device for enabling a user to record and audibly transmit an audio message or personal greeting. The audio system further includes a storage medium for enabling the user to store a pre-recorded audio message which is associated with the indicia on the exterior of the carrier. In this manner, the message may simulate the voice of the character or person depicted by the indicia. The carrier further includes a handle or strap for enabling the user to easily transport the carrier.

17 Claims, 1 Drawing Sheet

LUNCH BOX OR SIMILAR CARRIER INCORPORATING AN AUDIO RECORDING/ TRANSMITTING SYSTEM

This Application is a Continuation-In-Part of Ser. No. 09/216,755, filed Dec. 18, 1998; which is a Continuation of Ser. No. 08/792,286, filed Jan. 31, 1997, now abandoned. The entire contents of both applications are incorporated herein by reference.

BACKGROUND OF THE INVENTION

1. Field of the Invention.

The present invention relates generally to carriers or containers, such as lunch boxes, and more particularly to such devices incorporating an audio recording/transmitting system.

2. Description of the Related Art

The art to which the present invention relates includes carriers or containers, such as lunch boxes, generally designed to transport food items and/or beverages. It will be appreciated by those skilled in the art that it is convenient to have an apparatus capable of serving the dual functions of providing entertainment and transporting food items and/or beverages. To this end, there have been several attempts to devise containers which incorporate various audio components.

For example, U.S. Pat. No. 5,447,041, issued to Piechota, which is incorporated by reference as if fully set forth herein, is directed to a cover and built in audio system for an insulated cooler. The cover apparatus comprises a cover member having a recessed cavity for receiving the cover panel and audio system. Both the cover panel and the audio system are hingedly mounted on opposite sidewalls of the recessed cavity, and are movable between a closed position and an open position. The cover panel and the audio system include support devices for keeping the cover panel and the audio system in an open and upright configuration. The audio system is a standard system and is interchangeable with commonly manufactured am/fm radios, CD players, and/or tape cassettes which can be used within the recessed cavity of the cover member.

U.S. Pat. No. 4,279,342, issued to Van Pelt, which is incorporated by reference as if fully set forth herein, is directed to a lunch box employing a built in radio receiver. The radio is positioned on a side surface of the lunch box and held in position by means of a flexible bracket. The side surface includes a plurality of apertures for transmitting sound propagating from the radio. The front surface intermediate with the side surface has an aperture to enable a user to access control knobs positioned on the side surface of the receiver. A further aperture is covered by clear plastic to enable a user to view the station to which the radio is tuned. The radio is retained within the lunch box by means of the above referenced bracket, which is lined with an insulating foam to protect the radio from the items which may be carried within the lunch box.

U.S. Pat. No. 4,939,912 and U.S. Pat. No. 5,235,822, issued to Leonovich, Jr., which are incorporated by reference as if fully set forth herein, are directed to a combined portable cooler with audio system. The cooler includes an outer shell, an intermediate insulation layer, an inner shell, the partially removable top with handle for carrying the cooler and an inner compartment enclosed by four adjoining walls for holding food and beverages. The audio system may include a plurality of components including an AM/FM receiver, an AM/FM cassette deck, a compact disc player, one or more speakers, a power source battery, and a receptacle for an earphone jack, connected by a wiring circuit. Protective screens and waterproof sealing means are provided for keeping sand and moisture out of the speakers to improve quality of the sound. Insulation of the cooler also insulates the stereo components from sand, heat and moisture.

U.S. Pat. No. D237,134, issued to Westmoreland, which is incorporated by reference as if fully set forth herein, is directed to the ornamental design for a combined lunch box and radio.

U.S. Pat. No. 4,050,493, issued to Cho, which is incorporated by reference as if fully set forth herein, is directed to a ladies handbag incorporating a radio or other audio emitting device. A pocket is provided in the interior of the bag in which the audio device is disposed. Suitable apertures are formed through the exterior of the handbag to permit access to the control knobs of the audio device. An exterior protector covers the apertures to prevent damage to the device and to protect it from weather.

These containers incorporate into a single unit means for transporting food or other articles and means for providing entertainment However, until now, it is believed that a container, such as a lunch box, incorporating an audio recording/transmitting system which enables a user to record and transmit specific messages for identification and other purposes, has not been invented.

SUMMARY OF THE INVENTION

The present invention comprises a container or carrier, such as a lunchbox, incorporating means for recording, storing and audibly transmitting audio messages. In the preferred embodiment, the carrier includes a container having a substantially hollow interior defined by at least one exterior surface. The container may be constructed of any of a variety of suitable materials, including without limitation, plastics, metals, and synthetics. A handle, strap or other grasping means is provided for enabling the user to easily transport the carrier. A variety of container configurations are contemplated to be within the scope of the present invention. Thus, the at least one exterior surface may comprise a plurality of surfaces depending on the configuration of the container.

The at least one exterior surface of the carrier may further include indicia associated with a particular character, personality or theme, such as The Lion King, Bugs Bunny, Cinderella, sports or entertainment personalities and the like.

The carrier includes an audio system comprising various components for enabling the user to record and/or play a recorded audio message. The audio system is preferably contained within the interior of the container and is accessible from the exterior surface. Alternatively, the audio system may be mounted unobtrusively to the at least one exterior surface. Thus, as a preferred embodiment of the present invention, the audio system is permanently attached to the carrier. That is, the audio system is preferably not attached in a manner that uses adhesive stickers or VELCRO, or the like as a fastening means. Accordingly, in the preferred embodiment, the audio system cannot easily or accidentally be removed by a child during the course of the day.

The preferred embodiment of the audio system includes means for storing at least one recorded message and means for audibly transmitting the recorded message. One stored message may be a pre-recorded message that corresponds to the indicia associated with the exterior of the carrier. For example, a carrier bearing the likeness of Bugs Bunny would preferably include a message or greeting simulating the voice of Bugs Bunny.

The carrier further includes a recording device for enabling the user to record a message to be played independently of, or in conjunction with, the pre-recorded message associated with the indicia on the carrier. Preferably, the audio device of the present invention allows the playback of at least two separate messages. The audio message recordable by the user may include a personal greeting or message, or may provide information useful in identifying the owner of the carrier. Thus, the container bearing the likeness of Bugs Bunny may include a pre-recorded message simulating the voice of Bugs Bunny which may be played in conjunction with a message recorded by the user or owner of the container. For example, the message might say something to the effect that "What's up doe? This lunch box belongs to me and my friend (owner's name)". In this manner, the owner of the container, particularly if it is a child, may feel a certain degree of camaraderie with the character depicted on the container. In addition, the recording device enables another person to record a relevant message or greeting directed to the owner of the container. There is also preferably a child resistant mechanism that inhibits a user's ability to record over a previously recorded message. The purpose of such a mechanism is to inhibit a child's ability record over a parent's message. The nature of this mechanism is not critical, and preferably it is in the form of a switch on the inside of the container.

Control means are provided for enabling the user to record and/or play the message or greeting as desired, at least one speaker for audibly transmitting the message(s), and associated electrical circuitry for operably connecting the various audio system components. The devices for controlling the audio device to allow the user to record and/or play the message of greeting includes knobs, buttons, switches, etc. Preferably, the audio device is controlled by the use of a button recessed in the surface of the container, which allows the audio device to be hidden. That is, only the flushly positioned button is visible from the outside of the container. Additionally, one button may control the playback of more than one button, or each separate recorded message may have its own corresponding button.

It is an object of the present invention to provide a carrier, in the nature of a lunch box, which incorporates an audio recording/transmitting system.

It is another object of the present invention to provide a carrier for food items which includes recording and transmitting means for playing a pre-recorded message or greeting.

It is yet another object of the present invention to provide a carrier which includes a microchip or other means for storing an audio message which simulates the voice of a well-known or widely recognized character or personality, such as a sports figure, movie character, etc.

These and other objects, features and advantages shall become apparent after consideration of the description and drawings set forth herein. All such objects, features and advantage arc contemplated to be within to scope of the present invention even though not specifically set forth herein.

DESCRIPTION OF THE PREFERRED EMBODIMENT

Figure 2:
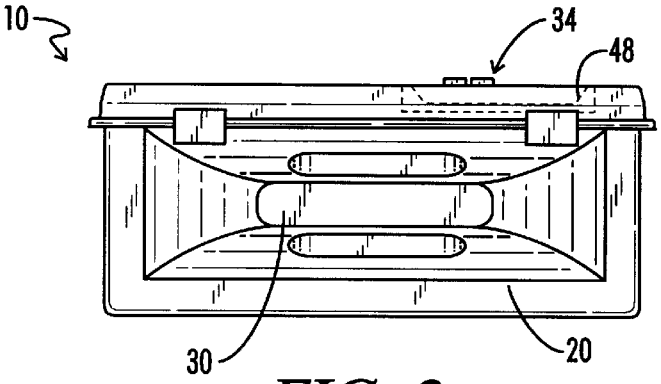
FIG. 2 is a top view of the embodiment of the invention shown in FIG. 1.
Figure 4:
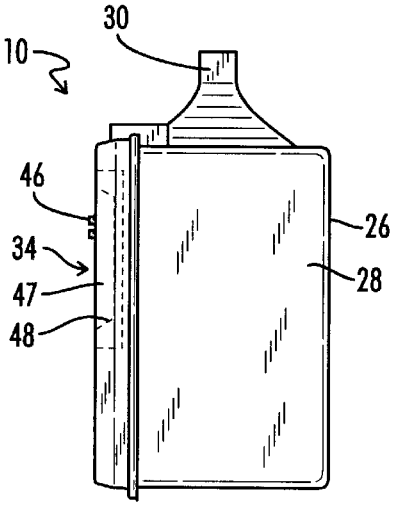
FIG. 4 is a side view of the embodiment of the invention shown in FIG. 1.
Figure 1:
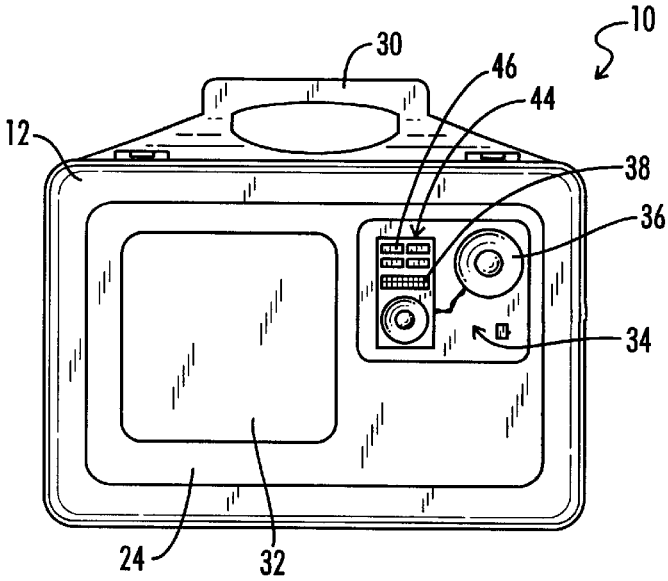
FIG. 1 is a front view of an embodiment of the present invention.
Figure 3:
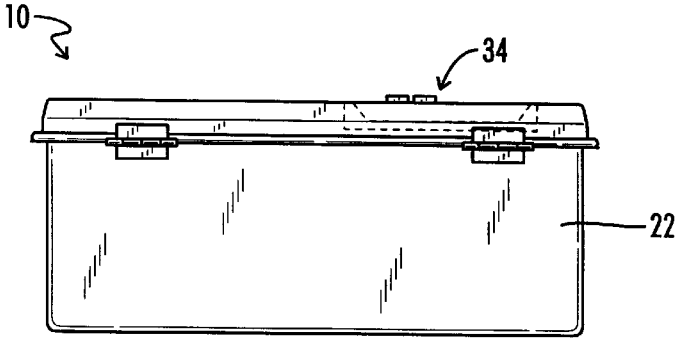
FIG. 3 is a bottom view of the embodiment of the invention shown in FIG. 1.

An embodiment of the present invention is designated generally by the reference numeral 10 in FIG. 1. Carrier 10 comprises a container 12 having a substantially hollow interior 14 (not shown) defined by at least one exterior surface 16.

In the preferred embodiment, the carrier 10 is formed by a plurality of adjacent or contiguous exterior enclosure walls, which may include a top wall 20, a bottom wall 22, a front wall 24, a back wall 26 and side walls 28. It is recognized, however, that carriers for food items, such as lunch boxes, may assume a variety of configurations, all of which are contemplated to be within the scope of the present invention. Thus, in addition to substantially square or rectangular box-type carriers, some carriers comprise soft-sided structures having a configuration similar to that of conventional paper sack. The carrier may be constructed of rigid materials, including without limitation, plastics and metals, or of less rigid materials, such as synthetics.

Grasping means, such as a handle or strap 30, are provided to enable the user to easily transport the carrier 10.

In the preferred embodiment, the at least one exterior surface 16 of the carrier 10 includes indicia 32 associated with a popular theme, entertainment character or well-known personality. As defined herein and in the claims, "well-known" refers to any movie, cartoon or television character, comic book character, famous personality, such as an entertainer or athlete, or any other popular or easily-recognizable person or character. For example, the indicia 32 may depict a movie character, such as Cinderella, a well-known sports personality, such as Michael Jordan, or a character from a book, such as Winnie-the-Pooh.

The carrier 10 further includes an audio recording and transmitting system 34 operably mounted thereto. The audio system 34 includes a speaker 36 for audibly transmitting a recorded message, a microphone 38 for enabling the user to record an audio message or personal greeting, and a medium, such as a microchip 40 (not shown), for storing recorded messages. The speaker 36 and the microphone 38 may be embodied in a single unit or in separate components.

The audio system 34 further includes a power source 42 (not shown), such as a battery, and control means 44 for enabling the user to selectively record and play an audio message as desired. The control means 44 may include a plurality of knobs or buttons 46 for controlling the various functions associated with recording and audibly transmitting a message. The control means 44 is preferably accessible from the at least one exterior surface 16 of the carrier 10 for purposes of convenience.

As stated above, knobs per se are not required for controlling the audio device. In fact, push buttons flushly mounted on an exterior surface of the container are preferred.

The medium preferably comprises a microchip 40 of the type typically found in a solid-state recording and playback device. Accordingly, the microchip 40 is capable of recording, storing and audibly playing a recorded sound or message. However, other suitable media, such as magnetic storage means, are contemplated to be within the scope of the present invention. The medium is capable of storing at least one message or sound recorded by the user, and at least one pre-recorded audio message, which preferably simulates the voice of a character associated with the indicia 32 on the container 10. For example, the message associated with a carrier 10 bearing the likeness of Bugs Bunny would simulate the voice of Bugs Bunny.

In the preferred embodiment, the audio system is disposed within a recess 47 formed in an exterior surface 16 of one of the enclosure walls of the carrier 10 to prevent damage thereto. The components of the audio system 34 may be enclosed in a housing 48 which is configured to be received within the recess 47.

Thus, although there have been described particular embodiments of the present invention of a new and useful audio recording and transmitting system in connection with a carrier such as a lunch box, it is not intended that such references be construed as limitations upon the scope of this invention except as set forth in the following claims.

What I claim is:

1. A carrier comprising:

a. a container having a substantially hollow interior defined by at least one exterior surface and a handle;

b. an audio system having a microchip permanently operably mounted to the container for enabling the user to record, store and transmit an audio message; and c. a mechanism accessible from the inside of the container to prevent user's ability to re-record a previously recorded message.

2. The carrier of claim 1, further comprising:

indicia positioned on the at least one exterior surface.

3. The carrier of claim 2 wherein the audio system further comprises:

a pre-recorded audio message.

4. A carrier for transporting food items comprising:

a. container means for receiving the food items, the container means having an interior defined by a plurality of enclosure walls and a handle;

b. indicia permanently affixed to an exterior surface of at least one of the plurality of enclosure walls;

c. an audio recording and transmitting device having a microchip permanently operably mounted to the container; and d. wherein the microchip includes at least one prerecorded stored audio message and means for recording at least one audio message which may be played in conjunction with the at least one prerecorded message, and the audio recording and transmitting device has a mechanism accessible from the inside of the container to prevent user's ability to re-record a previously recorded message.

5. The carrier of claim 4, wherein the audio system further comprises:

a microphone;

a speaker;

a medium for storing at least one audio message;

manual control means for enabling a user to select any of a plurality of functions associated with the recording, storing or transmitting of the audio message;

and a power source.

6. The carrier of claim 5 wherein the audio system is disposed within a recess formed in the container means and the control means.

7. The carrier of claim 5, wherein the pre-recorded message corresponds to the indicia.

8. The carrier of claim 5 wherein the medium for storing the at least one audio message comprises:

a microchip.

9. The carrier of claim 5 wherein the control means is accessible from an exterior surface of at least one of the plurality of enclosure walls.

10. The carrier of claim 7, further comprising:

a housing for enclosing the audio system.

11. A carrier for transporting food items, comprising:

a container having a substantially hollow interior formed by a plurality of adjacent enclosure walls and a handle;

indicia permanently affixed to an exterior surface of the at least one enclosure walls, walls, wherein the indicia is associated with a well-known character; and an audio recording and transmitting device having a microchip permanently mounted to the container and a mechanism accessible from the inside of the container to prevent a user's ability to re-record a previously recorded message; and wherein the microchip includes a prerecorded stored message and means for recording at least one audio message that can be played audibly in conjunction with the prerecorded message.

12. The carrier of claim 11 wherein the audio system further comprises:

means for recording, storing, and audibly transmitting at least one audio message;

means for controlling the recording and transmission of the at least one audio message; and a power source.

13. The carrier of claim 12 wherein the at least one audio message further comprises:

an audio message simulating the voice of a well-known character and associated with the indicia.

14. The carrier of claim 12 wherein the means for recording, storing and audibly transmitting at least one audio message comprises:

a microphone;

a speaker; and a medium for storing a recorded audio message;

means for controlling the recording of the at least one audio message and the transmission of the prerecorded stored message and the at least one audio message; and a power source.

15. The apparatus of claim 12 wherein the means for controlling the recording and transmission of the at least one audio message composes:

a plurality of knobs operably positioned on an exterior surface of one of the plurality of enclosure walls.

16. The apparatus of claim 14 wherein the power source comprises:

a battery.

17. The apparatus of claim 14 wherein the medium further comprises:

a microchip capable of recording and storing an audio message.

* * * * *